US006603402B2

(12) United States Patent
Lentine et al.

(10) Patent No.: US 6,603,402 B2
(45) Date of Patent: Aug. 5, 2003

(54) WATER SKIER ALERT SYSTEM AND TOW BAR HANDLE ASSEMBLY

(75) Inventors: Gregory E. Lentine, Orlando, FL (US); Louis F. Lentine, Jr., Windmere, FL (US)

(73) Assignee: Norcross Marine Products, Inc., Orlando, FL (US)

( * ) Notice: Subject to any disclaimer, the term of this patent is extended or adjusted under 35 U.S.C. 154(b) by 173 days.

(21) Appl. No.: 09/845,055

(22) Filed: Apr. 27, 2001

(65) Prior Publication Data

US 2002/0158766 A1 Oct. 31, 2002

(51) Int. Cl.[7] ..... G08B 23/00

(52) U.S. Cl. ..... 340/573.6; 340/539.1; 340/984

(58) Field of Search ..... 340/573.6, 665, 340/539.1, 984

(56) References Cited

U.S. PATENT DOCUMENTS

| | | | | |
|---|---|---|---|---|
| 4,483,683 A | | 11/1984 | Alley, Sr. | 441/69 |
| 4,624,141 A | * | 11/1986 | Soleau | 340/984 X |
| 4,689,611 A | | 8/1987 | Franklin | 340/539 |
| 4,934,972 A | | 6/1990 | Shumway et al. | 441/69 |
| 5,041,040 A | | 8/1991 | Jones et al. | 441/69 |
| 5,043,727 A | | 8/1991 | Ito | 340/984 |
| 5,167,550 A | | 12/1992 | Nielsen | 440/84 |
| 5,343,189 A | | 8/1994 | Alley, Sr. | 340/539 |
| 5,385,110 A | | 1/1995 | Bennett et al. | 114/285 |
| 5,408,221 A | | 4/1995 | Carsella, Sr. et al. | 340/604 |
| 5,694,337 A | * | 12/1997 | Macken | 700/91 |

FOREIGN PATENT DOCUMENTS

| | | |
|---|---|---|
| DE | 42 20 134 A1 | 12/1993 |
| WO | 93/00258 | 1/1993 |

* cited by examiner

*Primary Examiner*—Thomas Mullen
(74) *Attorney, Agent, or Firm*—Allen, Dyer, Doppelt, Milbrath & Gilchrist, P.A.

(57) ABSTRACT

A water skier alert system is used with a boat towing a water skier via a rope and tow bar handle secured thereto. A radio receiver is adapted to be positioned on the boat towing the water skier for receiving wireless radio signals transmitted from the tow bar handle in response to a skier down condition or water skier actuation of a desired water skier condition. A display is operative with the receiver and has indicia on the display that are actuated by the wireless transmitter signals and indicative of the skier down condition and each of desired water skier conditions. The tow bar handle includes at least one battery and a pressure sensor positioned at the grip portion and sensitive to hand and/or finger pressure exerted by a water skier. Control actuators are positioned along the grip portion and indicate a desired water skier condition. A wireless radio transmitter generates wireless signals indicative of a skier down condition when pressure is no longer exerted on the pressure sensor and desired water skier conditions after water skier actuation of the control actuators.

36 Claims, 4 Drawing Sheets

WATER SKIER ALERT SYSTEM AND TOW BAR HANDLE ASSEMBLY

FIELD OF THE INVENTION

This invention relates to water skier safety devices, and more particularly, this invention relates to wireless water skier alert systems.

BACKGROUND OF THE INVENTION

Water skiing is becoming a popular past time and recreational activity. It requires not only a boat operator driving a boat towing a water skier via a rope and tow bar handle secured thereto, but also an observer positioned in the boat as a passenger, who constantly monitors the water skier performance. The observer notes to the water skier whether the water skier indicates a desire for changed water skier conditions, such as speeding up, slowing down, or turning around, or has fallen and requires the boat to return and pull the water skier back up out of the water either into a skiing position, or draw the skier into the safety of the boat.

When an observer is not available, it is necessary to include a device to apprise immediately a boat operator if a skier has fallen or voluntarily released hold of the ski rope. This is necessary to ensure that the boat operator does not continue driving the boat a long distance from the location where the water skier has fallen, and thus, placing the water skier into a dangerous position where other boats could run over him or her. Some systems use a wire extending from a water skier tow bar handle to an alarm positioned within the boat indicating when a skier has fallen. This could be accomplished, such as when the tow bar handle hits the water and blocks a signal generated from a transmitter. Other systems, such as disclosed in U.S. Pat. No. 4,689,611, use a wireless transmitter for generating a signal that generates an alarm after the skier lets go of the tow bar handle. In these systems, a preselected frequency is no longer transmitted and an alarm is activated by closure of a switch.

Other systems use complicated tow bar handles, such as disclosed in U.S. Pat. No. 4,483,683, teaching a complicated handle assembly with on/off switches and manually actuated trigger switches. U.S. Pat. No. 5,408,221 discloses a downed water skier warning system using electronic water sensors for sensing when the rope-handle of the skier tow-rope lands in the water. These water and pressure sensors are in remote communication with audible and visual tow boat operator alarms and visual "skier down" warning indicators.

It would be advantageous if the standard cylindrically configured and longitudinally extending tow bar handle could be used with a skier alert system that generated not only an indication of a "skier down" signal, but generated other signals that indicate a desired water skier condition, such as speeding up, slowing down, or a directional turning around. It would also be advantageous if a simple system was provided for the boat operator to know when a skier down condition has occurred and when any change occurs in desired water skier conditions.

SUMMARY OF THE INVENTION

The present invention is advantageous and provides a water skier alert system that is used with a boat towing a water skier via a rope and tow bar handle secured thereto and allows a water skier to not only indicate to a boat operator any desired water skier conditions, but also indicate a skier down condition. The system of the present invention also indicates to a boat operator in a simple and uncomplicated manner whether a skier is down or what desired water skier conditions should be changed.

In accordance with the present invention, a water skier alert system of the present invention includes a radio receiver that is adapted to be positioned on the boat towing the water skier for receiving wireless radio signals transmitted from the tow bar handle in response to a skier down condition or the water skier's actuation of actuator controls to indicate a desired water skier condition. A display is operative with the receiver and has indicia on the display that are actuated by the wireless transmitter signals and indicative of the skier down condition and each of the desired water skier conditions.

In one aspect of the present invention, the desired water skier conditions comprise a speed up, a slow down and a turn around condition. The indicia on the display comprise an up arrow icon indicative of the speed up condition, a down arrow icon indicative of a slow down condition, and a turn around icon indicative of a turn around condition. A stop sign icon can be indicative of a skier down position. These indicia can be color coded and each can blink a predetermined number of times when actuated. An alarm can also be sounded for a predetermined period of time indicative of a desired water skier condition or a skier down condition. The alarm can sound for a longer period of time when indicating a skier down condition, indicating a greater emergency than when indicating a desired water skier condition. The alarm gives an audible indication to the boat operator to look down at the display momentarily, and thus, visually indicate the skier down condition or desired water skier condition.

In yet another aspect of the present invention, the water skier tow bar handle assembly comprises a cylindrically configured and longitudinally extending tow bar handle to which a tow rope is secured for towing a water skier and defining a surface having a grip portion over which the fingers and hands of the water skier clasps. The tow bar handle defines a battery compartment, and in one non-limiting aspect of the present invention, has at least one open end defining the battery compartment for receiving at least one battery.

In yet another aspect of the present invention, a battery compartment cover is removably mounted on the tow bar handle and contains at least one battery within the battery compartment. A pressure sensor is positioned at the grip portion and sensitive to hand and/or finger pressure exerted by a water skier. Control actuators are positioned along the grip portion and are water skier actuated to indicate a desired water skier condition. A wireless radio transmitter is positioned within the tow bar handle and operatively connected to a battery mounted within the battery compartment, the pressure sensor, and the control actuators for generating wireless signals indicative of a skier down condition when pressure is no longer exerted on the pressure sensor and desired water skier conditions after water skier actuation of the control actuators.

In one aspect of the present invention, an antenna is operatively connected to the wireless radio transmitter. It can be mounted on the tow bar handle, or inside, or other locations suggested by those skilled in the art. The antenna can also comprise a coil wound over the tow bar handle.

In yet another aspect of the present invention, the control actuators comprise three control buttons, one each for actuating the wireless transmitter and generating a wireless signal indicative of a desired speed up, slow down or turn around condition. Each pressure actuated control button can be responsive to pressure exerted by a water skier. These control buttons can include embedded control buttons positioned below the surface of the tow bar handle. In another aspect of the present invention, the control buttons are positioned about ⅛ inch below the surface of the handle that forms a grip for the handle.

In yet another aspect of the present invention, the pressure sensor extends substantially along the longitudinal direction of the grip portion. The wireless radio transmitter is automatically operative whenever pressure is exerted on the pressure sensor or when any of the control buttons are actuated. The wireless radio transmitter is automatically shut down after a predetermined time when no pressure is exerted on the pressure sensor or the control actuators are not actuated. The control actuators can be color coded for indicating desired conditions.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
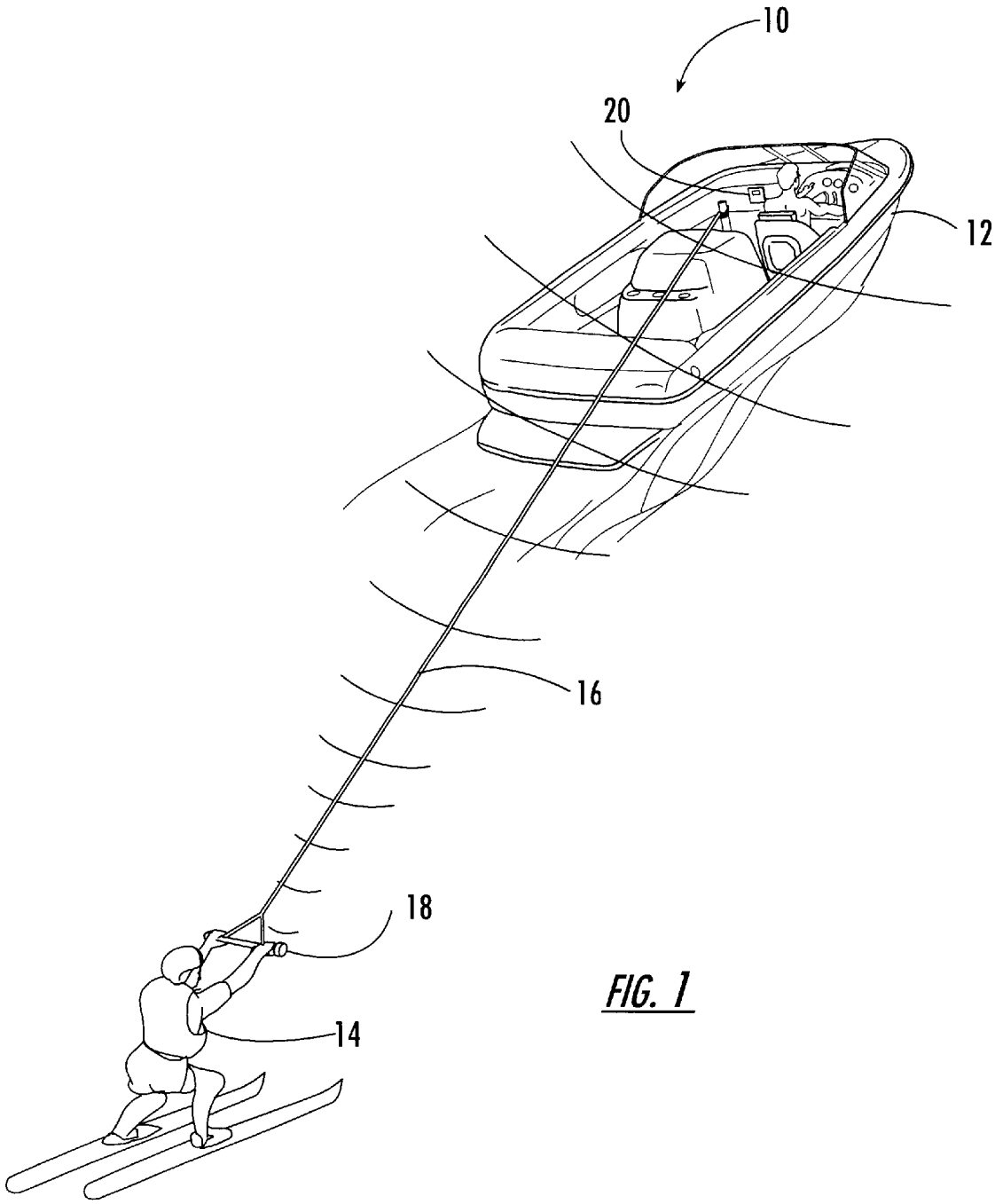
FIG. 1 illustrates a schematic, environmental view of the use of the water skier alert system of the present invention and showing various components of the system, including the water skier tow bar handle assembly and radio receiver and display unit positioned within a boat.

FIG. 1 illustrates an overall environmental view of a water skier alert system 10 of the present invention and showing a boat 12 towing a water skier 14 via a rope 16 and tow bar handle 18 secured thereto. The boat 12 includes only a boat operator (shown in phantom lines) and no observer to observe the water skier for a "skier down" condition, such as when the water skier has fallen, or an indication from the water skier of a desire to change water skier conditions, such as turning around, speeding up, or slowing down. The water skier alert system 10 includes a wireless radio receiver and display unit 20 that is positioned on the boat towing the water skier and receives wireless radio signals transmitted from the tow bar handle 18 in response to a skier down condition or water skier actuation of a desired water skier condition.

Figure 5:
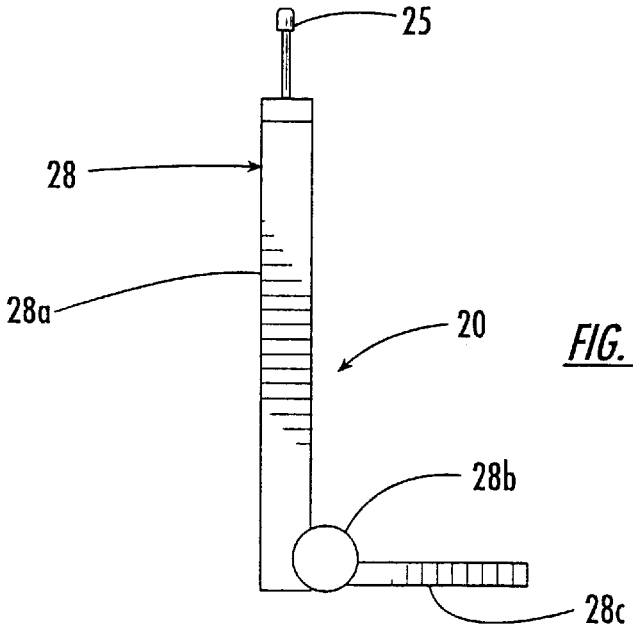
FIG. 5 is a side elevation view of an adjustable built-in stand that can be used for holding the radio receiver and display unit of the present invention.

The radio receiver and display unit 20 includes a visual display 22 that is operative with a wireless radio receiver 24 that receives signals via antenna 25. The display 22 includes indicia 26 that are actuated via a processor 27 (FIG. 6) by wireless transmitter signals from the tow bar handle and indicative of a skier down condition and each of the desired water skier conditions. The radio receiver and display unit 20 is preferably built in one non-limiting example as an integral unit that is placed on an adjustable, built-in stand 28 that can be tilted in any desired angular direction to enhance the viewing angle by the boat operator (FIG. 5). The built-in stand 28 can include a back support 28*a*, pivot mount 28*b* and horizontal support 28*c*, which can be attached to a support on the boat.

Figure 2:
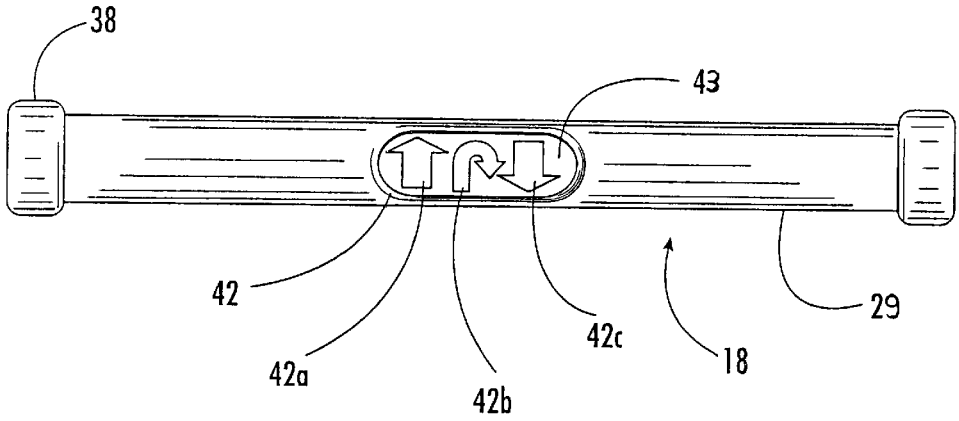
FIG. 2 is a more detailed view of the water skier tow bar handle assembly and showing the end cap and control actuators.
Figure 3:
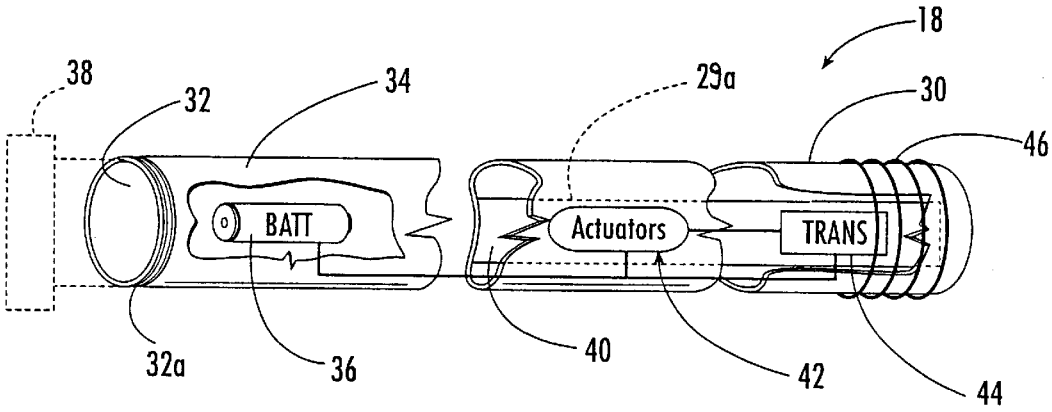
FIG. 3 is a fragmentary drawing of the water skier tow bar handle assembly, showing various components including the pressure sensor, battery compartment and battery, control actuators, wireless radio transmitter, and antenna.

The water skier tow bar handle 18 is formed as an assembly of component parts as a cylindrically configured and longitudinally extending member to which the tow rope 16 is secured for towing the water skier. As shown in FIGS. 2 and 3, the tow bar handle assembly defines a surface having a grip portion 29 over which the fingers and hands of a water skier clasp. This grip portion 29 can be formed from rubber or other similar grip material that enhances the water skier grip on the handle. This grip material is formed, in one aspect of the present invention, over a cylindrically configured and longitudinally extending body member 30 (FIG. 3), which contains the various components of the tow bar handle assembly.

As illustrated, the tow bar handle 18 has at least one open end 32 and defines a battery compartment 34 within the interior of the body member 30 for receiving at least one battery 36. A battery compartment cover is formed in this illustrated aspect of the present invention as an end cap 38 and is removably mounted on the open end 32 of the tow bar handle. It holds the at least one battery within the battery compartment. Naturally, the end cap is water sealed when positioned over the open end and can include threads for sealingly engaging threads 32*a* positioned on the open end of the handle. It is possible that the battery compartment could be formed with a side access panel.

The grip portion 29 includes a front grip portion 29*a* having a pressure sensor 40 positioned at that location and sensitive to hand and/or finger pressure exerted by the water skier. The pressure sensor 40 can be formed as a longitudinally extending pressure strip, as illustrated in FIG. 3, which extends along the front grip portion 29*a*. This strip can be embedded in the rubber or other grip material or on the outer surface. The pressure sensor 40 could also be positioned under the grip material forming the grip portion and against the body member 30.

Control actuators 42 are positioned along the rear grip portion 29*b* facing the water skier and indicate through user actuation a desired water skier condition, such as a water skier desire to speed up, slow down, or turn around. In one aspect of the present invention, these control actuators are pressure actuated control buttons that respond to pressure exerted by the water skier. As illustrated, three control buttons 42*a*, 42*b* and 42*c* are illustrated that are user actuated for indicating speed up, turn around, or slow down. In one aspect of the invention, each button is positioned about ⅛ inch below the surface of the handle in an open slotted area 43 formed within the grip material and the cylindrically configured body member 30. Each button, however, could be formed flush or some other depth instead of ⅛ inch. In one aspect of the invention, the buttons 42*a*, 42*b*, 42*c* are configured as an up arrow to indicate a speed up for the desired water skier condition, a down arrow to indicate a slow down for the desired water skier condition, and a 180° arrow turn to indicate a turn around condition.

As illustrated, a wireless radio transmitter 44 is positioned and sealed in a waterproof manner within the tow bar handle and is operatively connected to the battery 36 mounted within the battery compartment 34, the pressure sensor 40, and the control actuators 42 for generating wireless signals to the radio receiver and display unit 20 indicative of a skier down condition when pressure is no longer exerted on the pressure sensor 40 and desired water skier conditions after skier actuation of the control actuators 42.

An antenna 46 is operatively connected to the wireless radio transmitter 44. It can be mounted on or inside the tow bar handle 18, or at other locations suggested by those skilled in the art. In one aspect of the invention, it is mounted as a coil wound over the tow bar handle, as illustrated. Although any number of wireless radio transmitters can be used in the present invention, a simple spread spectrum wireless transmitter that is operative within unlicensed bands established by the Federal Communications Commission or an FM or other similar wireless radio transmitter could be used. The electronics associated with the wireless radio transmitter include basic electronic circuitry known to those skilled in the art for generating wireless signals indicative of a skier down condition or desired water skier conditions, such as a wireless signal indicative of speed up, a wireless signal indicative of slow down, or a wireless signal indicative of a turn around condition. These wireless signals could form many types of modulation, such as a simple on/off pulse modulation as in Morse code, or the more complicated modulation and coding arrangements for indicating the desired water skier conditions and skier down condition.

The control actuators 42*a*, 42*b* and 42*c* can be color coded for indicating the desired conditions and to facilitate any water skier's selection of the control actuators based on a color difference. For example, the speed up control actuator 42*a* could be green, the slow down control actuator 42*b* could be yellow, and the turn around control actuator 42*c* could be blue.

The display 22 of the radio receiver and display unit 20 acts as a gauge to indicate the skier down condition or indicate a change in the desired water skier conditions after a water skier actuates the control actuators 42 or the water skier lets go of the tow bar handle, and thus, the pressure sensor, such as when the skier falls. In one aspect of the present invention, the display 22 is formed as a liquid crystal display (LCD) and includes indicia 26, such as four icons, each indicative of what the water skier has actuated, such as stop sign icon 50*a* that is indicative of the skier down condition, and icons 50*b*, 50*c* and 50*d* that are configured similar to the indicia of the control actuator buttons, as illustrated, which indicated the speed up, slow down, or turn around desired skier conditions. It should be understood, however, that any number of different icon designs or other indicia configurations can be used for both the indicia on the display and the control actuators on the tow bar handle.

In one preferred aspect of the present invention as illustrated, simple designs, such as the illustrated stop sign and arrows, are used. The LCD can be a color LCD display and the indicia 26, e.g., the icons, can be color coded in the same color as the control actuators. The stop sign icon can be the color red and can light when the skier is down and has dropped the tow bar handle. Additionally, the display could be an LED, instead of an LCD, depending on cost.

Each icon or other indicia 26 used on the display can blink five times to aid in capturing the boat operator's attention and allowing the boat operator to observe that a condition has changed. The display could be programmed such that the icons blink fewer than five times, or greater than five times, as desired, by individual action and choice.

In another aspect of the present invention, an alarm 54 is operatively connected to the wireless radio receiver and display unit 20 (FIG. 4) and can sound for three seconds for each action, indicating a change in water skier conditions, such as speed up, slow down, or turn around. The alarm 54 can sound for a longer, five second period, indicative of a skier down condition, which is more important and demands immediate attention by the boat operator. Each condition change indicated on the display could have its own distinctive tone or series of tones when the alarm is generated. Thus, it is possible that the boat operator would not have to look down at the display to determine what condition has changed.

Figure 6:
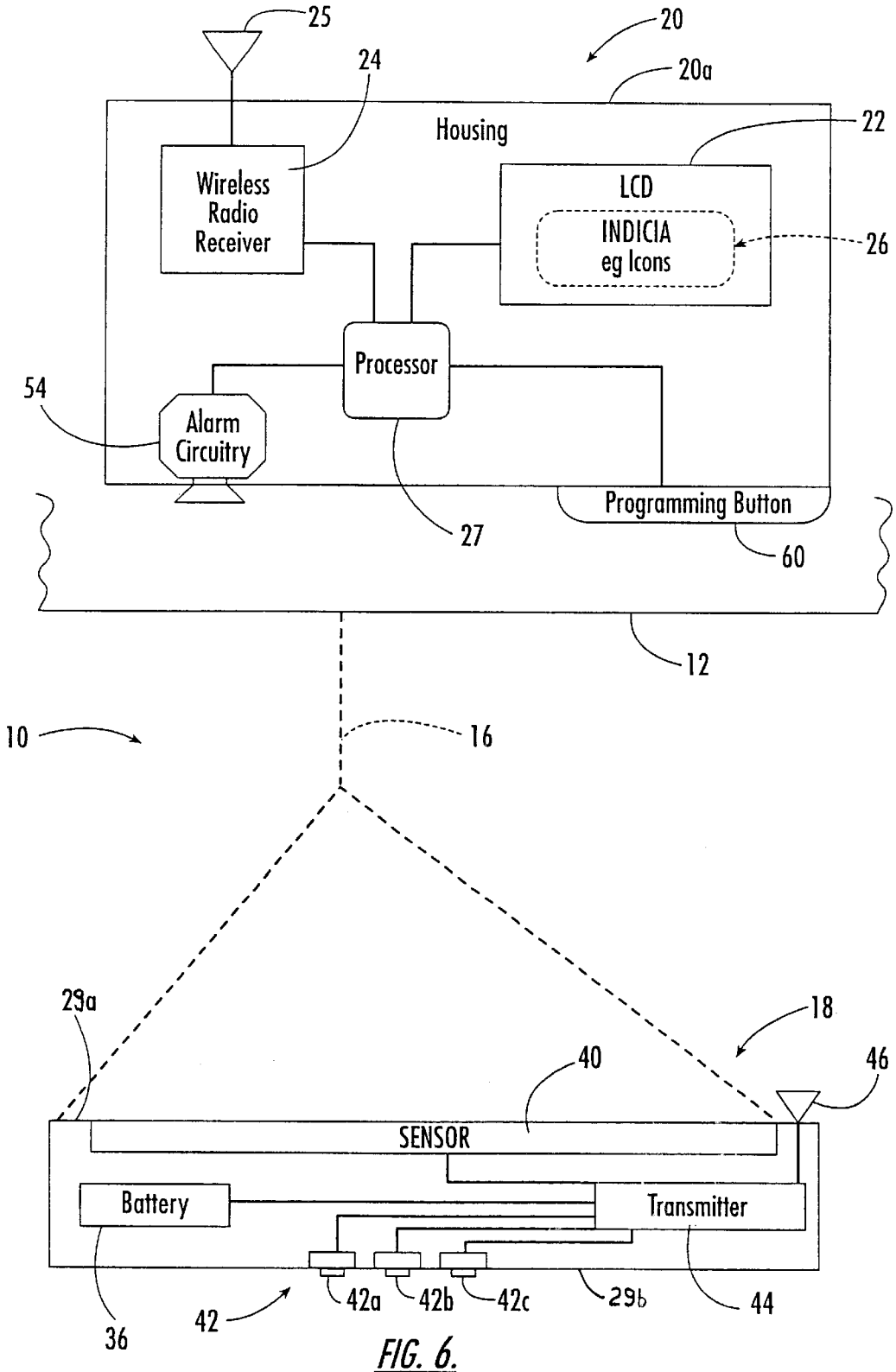
FIG. 6 is a block diagram showing one example of the type of circuits that can be used with the water skier alert system of the present invention.

FIG. 6 illustrates a schematic block diagram of the skier alert system 10 showing the radio receiver and display unit 20 and the tow bar handle 18. As illustrated, the tow bar handle 18 includes the previously discussed components, including the battery 36, wireless transmitter 44, pressure sensor 40, antenna 46 and control actuators 42 as three buttons that can be selected by the water skier for actuating the transmitter to transmit a wireless signal.

Figure 4:
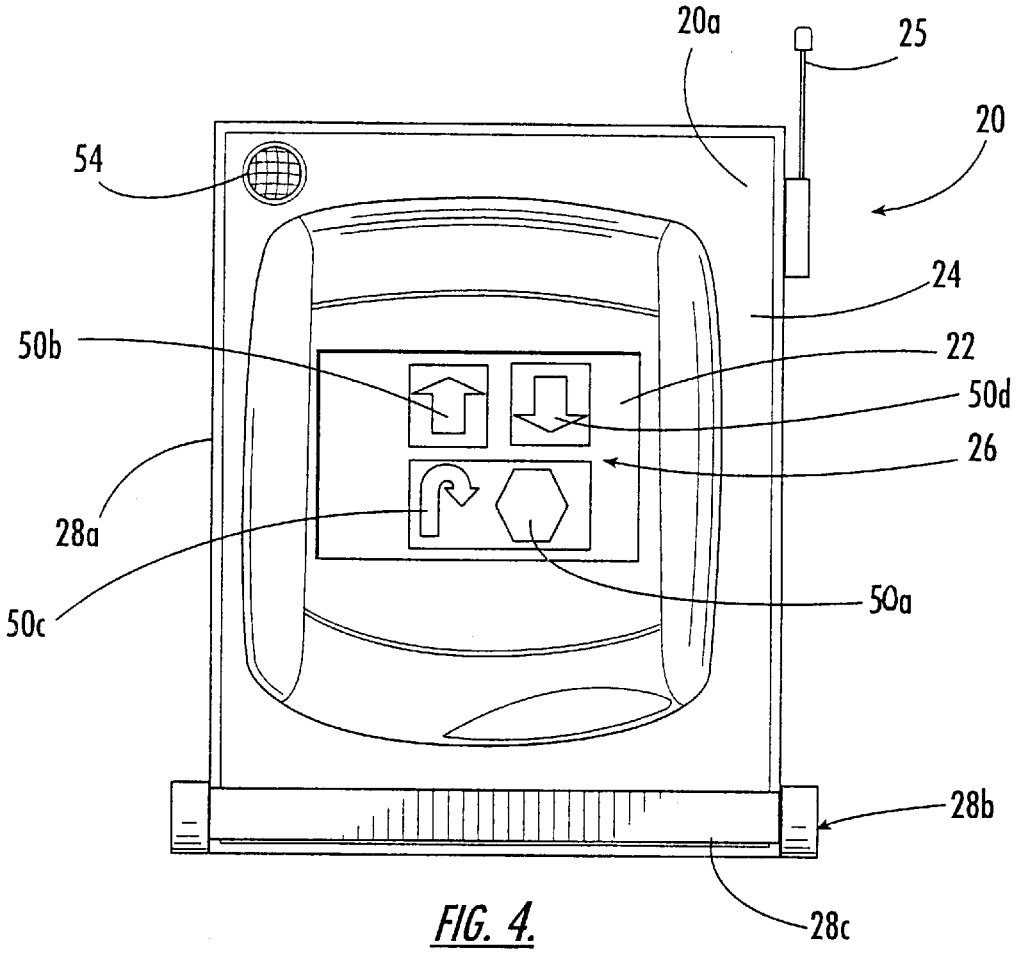
FIG. 4 is an elevation view of the display and receiver that can be used with the present invention.

The radio receiver and display unit 20 includes a housing 20*a*, as also illustrated in FIG. 4, supporting the LCD display 22 with the various indicia 26, e.g., icons. The radio receiver 24 is connected to the antenna 25 and receives signals from the tow bar handle 18. A microprocessor 27 or other controller is connected to the wireless radio receiver 24 and the LCD 22 and generates the appropriate signals for displaying the proper icons on the display. A series of programming buttons or a simple one touch programming button 60, as illustrated, is operatively connected to the microprocessor 27 and allows a user to program the display and alarm system for actuating different types of icons and different audible alarms. These components can be selected and configured in a circuit design as known to those skilled in the art.

It is evident that the present invention allows a boat operator to determine changed skier conditions in a simple and efficient manner, while also allowing a water skier to signal the boat operator of any desire for speeding up, turning around, slowing down or other desired skier conditions in a simple and efficient manner. The tow bar handle does not have to be changed in a configuration as normal and the display can be easily mounted with the wireless radio receiver on the adjustable built-in stand, while allowing audible alarms that can be programmed by the user.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. A water skier tow bar handle assembly comprising:

a cylindrically configured and longitudinally extending tow bar handle to which a tow rope can be secured for towing a water skier and defining a surface having a grip portion over which the fingers and hands of a water skier clasp, said tow bar handle defines a battery compartment for receiving at least one battery;

a battery compartment cover that is removably mounted on the tow bar handle for containing the at least one battery within the battery compartment;

a pressure sensor positioned at the grip portion and sensitive to hand and/or finger pressure exerted by a water skier;

control actuators positioned along the grip portion and actuated by a water skier and indicative of a desired water skier condition; and a wireless radio transmitter positioned within the tow bar handle and operatively connected to a battery mounted within said battery compartment, said pressure sensor, and said control actuators for generating wireless signals indicative of a skier down condition when pressure is no longer exerted on the pressure sensor and desired water skier conditions after water skier actuation of said control actuators.

2. A water skier tow bar handle assembly according to claim 1, wherein said desired water skier conditions comprise a speed up, a slow down and a turn around condition.

3. A water skier tow bar handle assembly according to claim 1, and further comprising an antenna operatively connected to said wireless radio transmitter.

4. A water skier tow bar handle assembly according to claim 3, wherein said antenna comprises an antenna coil wound over said tow bar handle.

5. A water skier tow bar handle assembly according to claim 1, wherein said control actuators comprise three control buttons, one each for actuating said wireless transmitter and generating a wireless signal indicative of a desired speed up, slow down or turn around condition.

6. A water skier tow bar handle assembly according to claim 1, wherein said control actuators comprise pressure actuated control buttons that respond to pressure exerted by a water skier.

7. A water skier tow bar handle assembly according to claim 6, wherein said pressure actuated control buttons comprise embedded control buttons positioned below the surface of the tow bar handle.

8. A water skier tow bar handle assembly according to claim 1, wherein said pressure sensor extends substantially along the longitudinal direction of said grip portion.

9. A water skier tow bar handle assembly according to claim 1, wherein said wireless radio transmitter is automatically operative whenever pressure is no longer exerted on said pressure sensor or when any of said control buttons are actuated.

10. A water skier tow bar handle assembly according to claim 1, wherein said wireless radio transmitter is automatically shut-down after a predetermined time when no pressure is exerted on said pressure sensor or said control actuators are not actuated.

11. A water skier tow bar handle assembly according to claim 1, wherein said control actuators are color coded for indicating desired conditions.

12. A water skier alert system used with a boat towing a water skier via a rope and tow bar handle secured thereto comprising:

a radio receiver that is adapted to be positioned on the boat towing the water skier for receiving wireless radio signals transmitted from the tow bar handle in response to a skier down condition or water skier actuation of a desired water skier condition; and a display operative with the receiver and having indicia on the display that are actuated by said wireless transmitter signals and indicative of the skier down condition and each of water skier conditions.

13. A water skier alert system according to claim 12, wherein said desired water skier condition comprise a speed up, a slow down and a turn around condition.

14. A water skier alert system according to claim 12, wherein said indicia comprise an up arrow icon indicative of a speed up condition, a down arrow icon indicative of a slow down condition, a turn around icon indicative of a turn around condition.

15. A water skier alert system according to claim 12, wherein said indicia that is indicative of a skier down condition comprises a stop sign icon.

16. A water skier alert system according to claim 12, wherein said indicia are color coded.

17. A water skier alert system according to claim 12, wherein said indicia blink a predetermined number of times when actuated.

18. A water skier alert system according to claim 12, and further comprising an alarm that sounds for a predetermined period of time indicative of a desired skier condition or a skier down condition.

19. A water skier alert system according to claim 18, wherein said alarm sounds for a longer period of time when indicating a skier down condition than when indicating desired water skier conditions.

20. A water skier alert system used with a boat towing a water skier via a rope and tow bar handle secured thereto comprising:

a cylindrically configured and longitudinally extending tow bar handle to which a tow rope is secured for towing a water skier and defining a surface having a grip portion over which the fingers and hands of a water skier clasp, said tow bar handle defining a battery compartment for receiving at least one battery;

a battery compartment cover that is removably mounted on the tow bar handle for containing at least one battery within the battery compartment;

a pressure sensor positioned at the grip portion and sensitive to hand and/or finger pressure exerted by a water skier;

control actuators positioned along the grip portion and indicating a desired water skier condition;

a wireless radio transmitter positioned within the tow bar handle and operatively connected to a battery mounted within battery compartment, said pressure sensor, and said control actuators for generating wireless signals indicative of a skier down condition when pressure is no longer exerted on the pressure sensor and desired water skier conditions after actuation of said control actuators;

a radio receiver that is adapted to be positioned on the boat towing the water skier for receiving wireless radio signals transmitted from the tow bar handle; and a display operative with the receiver and having indicia on the display that are actuated by said wireless transmitter signals and indicative of the skier down position and each of water skier conditions.

21. A water skier alert system according to claim 20, wherein said desired water skier conditions comprise a speed up, a slow down and a turn around condition.

22. A water skier alert system according to claim 20, and further comprising an antenna operatively connected to said wireless radio transmitter.

23. A water skier alert system according to claim 20, wherein said antenna comprises a coil wound over said handle.

24. A water skier alert system according to claim 20, wherein said control actuators comprise three control buttons, one each for actuating said wireless transmitter and generating a wireless signal indicative of a desired speed up, slow down or turn around condition.

25. A water skier alert system according to claim 20, wherein said control actuators comprise pressure actuated control buttons that respond to pressure exerted by a water skier.

26. A water skier alert system according to claim 25, wherein said control buttons comprise embedded control buttons positioned below the surface of the tow bar handle.

27. A water skier alert system according to claim 25, wherein said pressure sensor extends substantially along the longitudinal direction of said grip portion.

28. A water skier alert system according to claim 27, wherein said wireless radio transmitter is automatically operative whenever pressure is no longer exerted on said pressure sensor or when any of said control buttons are actuated.

29. A water skier alert system according to claim 27, wherein said wireless radio transmitter is automatically shut-down after a predetermined time when no pressure is exerted on said pressure sensor or said control actuators are not actuated.

30. A water skier alert system according to claim 20, wherein said control actuators are color coded for indicating desired conditions.

31. A water skier alert system according to claim 20, wherein said indicia comprise an up arrow icon indicative of a speed up condition, a down arrow icon indicative of a slow down condition, a turn around icon indicative of a turn around condition.

32. A water skier alert system according to claim 20, wherein said indicia that is indicative of a skier down position comprises a stop sign icon.

33. A water skier alert system according to claim 20, wherein said indicia are color coded.

34. A water skier alert system according to claim 20, wherein said indicia blink a predetermined number of times when actuated.

35. A water skier alert system according to claim 20, and further comprising an alarm that sounds for a predetermined period of time indicative of a desired water skier condition or a skier down condition.

36. A water skier alert system according to claim 35, wherein said alarm sounds for a longer period of time when indicating a skier down condition than when indicating a water skier condition.

* * * * *